US010233696B2

(12) United States Patent
Casad

(10) Patent No.: US 10,233,696 B2
(45) Date of Patent: Mar. 19, 2019

(54) DRILL BIT

(71) Applicant: ULTERRA DRILLING TECHNOLOGIES, L.P., Fort Worth, TX (US)

(72) Inventor: Christopher M. Casad, Benbrook, TX (US)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 513 days.

(21) Appl. No.: 14/742,339

(22) Filed: Jun. 17, 2015

(65) Prior Publication Data

US 2015/0368979 A1 Dec. 24, 2015

Related U.S. Application Data

(60) Provisional application No. 62/013,802, filed on Jun. 18, 2014.

(51) Int. Cl.

| | |
|---|---|
| ***E21B 10/02*** | (2006.01) |
| ***E21B 10/42*** | (2006.01) |
| ***E21B 10/43*** | (2006.01) |
| ***E21B 10/60*** | (2006.01) |

(52) U.S. Cl.

CPC ..... *E21B 10/42* (2013.01); *E21B 10/02* (2013.01); *E21B 10/43* (2013.01); *E21B 10/602* (2013.01)

(58) Field of Classification Search

CPC ..... E21B 10/42; E21B 10/602; E21B 10/55; E21B 2010/425; E21B 2010/545

USPC ..... 175/401, 421

See application file for complete search history.

(56) References Cited

U.S. PATENT DOCUMENTS 1,923,488 A * 8/1933 Howard ..... E21B 10/006 175/421
2,783,973 A * 3/1957 Hawthorne ..... E21B 10/43 175/391
3,180,440 A * 4/1965 Bridwell ..... E21B 10/54 175/393
3,251,425 A * 5/1966 Bridwell ..... E21B 10/62 175/279
4,351,401 A * 9/1982 Fielder ..... E21B 10/573 175/428
4,714,120 A * 12/1987 King ..... E21B 10/43 175/431

(Continued)

FOREIGN PATENT DOCUMENTS

CA 2952937 A1 * 12/2015 ..... E21B 10/42
SU 378618 A1 * 4/1973

OTHER PUBLICATIONS

SU 378618 A1 English Translation, provided by EPO , 2 pages (Year: 1972).*

(Continued)

*Primary Examiner* — Jennifer H Gay
(74) *Attorney, Agent, or Firm* — Kilpatrick Townsend & Stockton LLP

(57) ABSTRACT

A drag bit includes a blade extending from the bit body and supporting inner cutters proximate the longitudinal axis and outer cutters spaced from the longitudinal axis. The inner cutters are rotationally offset from the outer cutters. During operation the inner cutters deposit cut material in a channel that is contiguous with a channel that receives material cut by the outer cutters. The cutters and the contiguous channels flush agglomerating material from the slots.

43 Claims, 9 Drawing Sheets

(56) References Cited

U.S. PATENT DOCUMENTS 5,103,922 A * 4/1992 Jones ..... E21B 10/55 175/421
5,186,268 A * 2/1993 Clegg ..... E21B 10/43 175/399
5,244,039 A * 9/1993 Newton, Jr. ..... E21B 10/43 175/431
6,062,325 A * 5/2000 Taylor ..... E21B 10/42 175/378
6,808,031 B2 * 10/2004 Mensa-Wilmot ..... E21B 10/5735 175/374
7,703,557 B2 * 4/2010 Durairajan ..... E21B 10/43 175/327
7,762,355 B2 * 7/2010 McClain ..... E21B 10/55 175/431
8,418,785 B2 * 4/2013 Azar ..... E21B 10/55 175/420.1
8,439,136 B2 * 5/2013 Jones ..... E21B 10/55 175/431
9,359,825 B2 * 6/2016 Gavia ..... E21B 10/43
9,366,090 B2 * 6/2016 Azar ..... E21B 10/26
2008/0179108 A1 * 7/2008 McClain ..... E21B 10/43 175/431
2008/0302575 A1 * 12/2008 Durairajan ..... E21B 10/43 175/327
2009/0084606 A1 * 4/2009 Doster ..... E21B 10/42 175/327
2010/0252332 A1 * 10/2010 Jones ..... E21B 10/55 175/413
2011/0100724 A1 * 5/2011 Azar ..... E21B 10/43 175/428
2012/0205163 A1 * 8/2012 Azar ..... E21B 10/26 175/428
2013/0153305 A1 * 6/2013 Chrest ..... E21B 10/43 175/336

OTHER PUBLICATIONS

"Ridge", https://www.thefreedictionary.com/ridge, 6 pages (Year: 2018).*
Varhaug, Matt (Schlumberger), "Bits", 2016, 2 pages (Year: 2016).*

* cited by examiner

DRILL BIT

TECHNICAL FIELD OF THE INVENTION

This invention is related in general to the field of drill bits. More particularly, the invention is related to rotary drag bits with blades supporting cutters.

BACKGROUND OF THE INVENTION

In a typical drilling operation, a drill bit is rotated while being advanced into a rock formation. There are several types of drill bits, including roller cone bits, hammer bits and drag bits. There are many drag bit configurations of bit bodies, blades and cutters.

Drag bits typically include a body with a plurality of blades extending from the body. The bit can be made of steel alloy, a tungsten matrix or other material. Drag bits typically have no moving parts and are cast or milled as a single-piece body with cutting elements brazed into the blades of the body. Each blade supports a plurality of discrete cutters that contact, shear and/or crush the rock formation in the borehole as the bit rotates to advance the borehole. Cutters on the shoulder of drag bits effectively enlarge the borehole initiated by cutters on the nose and in the cone, or center, of the drill bit.

FIG. 1 is a schematic representation of a drilling operation 2. In conventional drilling operations a drill bit 10 is mounted on the end of a drill string 6 comprising drill pipe and drill collars. The drill string may be several miles long and the bit is rotated in the borehole 4 either by a motor proximate to the bit or by rotating the drill string or both simultaneously. A pump 8 circulates drilling fluid through the drill pipe and out of the drill bit flushing rock cuttings from the bit and transporting them back up the borehole. The drill string comprises sections of pipe that are threaded together at their ends to create a pipe of sufficient length to reach the bottom of the borehole 4.

Cutters mounted on blades of the drag bit can be made from any durable material, but are conventionally formed from a tungsten carbide backing piece, or substrate, with a front facing table comprised of a diamond material. The tungsten carbide substrates are formed of cemented tungsten carbide comprised of tungsten carbide particles dispersed in a cobalt binder matrix. The diamond table, which engages the rock formation, typically comprises polycrystalline diamond ("PCD") directly bonded to the tungsten carbide substrate, but could be any hard material. The PCD table provides improved wear resistance, as compared to the softer, tougher tungsten carbide substrate that supports the diamond during drilling.

Cutters shearing the rock in the borehole are typically received in recesses along the leading edges of the blades. The drill string and the bit rotate about a longitudinal axis and the cutters mounted on the blades sweep a radial path in the borehole, failing rock. The failed material passes into channels between the bit blades and is flushed to the surface by drilling fluid pumped down the drill string.

Some materials the bit passes through tend to clog the channels and reduce the efficiency of the bit in advancing the borehole. As the bit fails materials such as shale at the borewall, the material quickly absorbs fluid and can form clays that are sticky. Clays can form ribbons as it is cut from the bore that agglomerate and can cling to the surface of the bit in the channels. This narrows the channels and can inhibit flushing of new material to the surface. The material expands as it absorbs water and pressure increases in the channels of the bit. While this pressure in the channel can help flush less sticky material from the channel, the pressure can cause clay to stick to the channel walls. This causes the bit to bog down and limits the volume of new material that can be processed through the channel.

Bits configured to advance boreholes through materials of finer consistency that form clays and flush the failed materials more efficiently out of channels without clogging can be advantageous.

SUMMARY OF THE INVENTION

The present invention pertains to drilling operations where a rotating bit with cutters advances a borehole in the earth. The bit is attached to the end of a drill string and is rotated to fail the rock in the borehole. Cutters on blades of a bit contact the formation and fail the rock of the borehole by shearing or crushing.

The present invention provides a bit with channels that better process material cut from the borehole by the cutters. The channels function to remove and flush materials such as ribbons of clay materials that can agglomerate and stick to the surface of the channel. When the material sticks in the channel, the channel is significantly narrowed and becomes clogged. Inefficient removal of these clay-like materials can limit the rate of penetration as new material cannot readily pass through the channels clogged by earlier materials.

In one embodiment, a drill bit includes a blade with a leading edge that supports an inner set of cutters along an inner leading edge portion of the blade, and an outer set of cutters along an outer leading edge portion of the blade that is rotationally offset from the first leading edge portion.

In another embodiment, a drill bit includes an inner channel, an inner nozzle at the inner end of the inner channel, an inner set of cutters behind the inner channel, an outer channel contiguous with the inner channel, an outer nozzle at the inner end of the outer channel, and an outer set of cutters behind the outer channel. The inner set of cutters are rotationally offset and forward of the outer cutters. The inner channel flushes material from the inner set of cutters and the outer channel flushes material from the outer set of cutters.

In another embodiment, a drill bit includes a bit face with an inner region proximate a longitudinal axis of the bit with one or more cutters and an outer region spaced from the longitudinal axis that includes one or more cutters. The inner region cutters are rotationally offset and forward from the outer region cutters.

In another embodiment, a drag bit comprises a body with a rotational axis including a forward blade and a rearward blade each upstanding from the bit body to define a front edge and a rear edge. Each of the blades extend radially outward from the longitudinal axis. The front edge of the rearward blade and the rear edge of the forward blade define a channel between the two blades. The rearward blade includes one or more inner cutters on an inner portion of the front edge, and one or more outer cutters on the outer portion of the front edge. The outer cutters are offset rearward from the first set of cutters to expand the channel so as to reduce the risk of clogging.

In another embodiment, a method of flushing cuttings from the face of a drill bit includes directing drilling fluid through a first nozzle forward of a first set of cutters along an inner leading edge of a blade, and directing drilling fluid through a second nozzle rearward of the first set of cutters and forward of a second set of cutters on an outer leading edge of the blade.

In another embodiment of the invention, a drill bit includes a blade that supports an inner set of cutters generally along a first line or arc, and an outer set of cutters extending along a second line or arc rotationally and/or rearwardly offset from the first line.

In another embodiment of the invention, a channel portion and nozzle forward of an inner set of cutters works in tandem with a channel portion and nozzle forward of an outer set of cutters rotationally offset from the inner cutters. The channel portions are contiguous and each channel flushes material primarily from one set of cutters.

In another embodiment of the invention, the bit face includes an inner region about the longitudinal axis of the bit with one or more first cutters. The bit also includes an outer region spaced from the longitudinal axis and outside the inner region that includes one or more second cutters. The cutters of the inner region are rotationally offset from the cutters of the outer region.

In another embodiment of the invention, a core bit for collecting a core sample includes a bit body with an opening for the core sample, blades with a width and a thickness from the bit body extending from the opening around shoulders of the bit body, an inner cutter mounted on a leading edge of a first blade adjacent the opening to cut the core sample and a set of outer cutters spaced from the opening mounted to the leading edge of the first blade extending along a line away from the opening and rotationally offset from the inner cutter.

In some embodiments of the invention, the outer cutters are arranged generally along a line that is radially curved extending from the rotational axis or other location. In some embodiments of the invention, the bit has three blades each with an inner set of cutters and an outer set of cutters aligned along two lines offset from each other. In some embodiments of the invention, the bit has six or seven blades. In some embodiments of the invention, the blade with an inner set of cutters and an outer set of cutters has a thickness that is continuous without abrupt changes or gaps other than the offset between the inner and outer regions. In some embodiments of the invention, the blade with an inner set of cutters and an outer set of cutters extends from the axis of rotation and around a shoulder of the bit.

The different features of the various embodiments of the invention are usable independently or in combination with the features of other embodiments. Moreover, other aspects, advantages, and features of the invention will be described in more detail below and will be recognizable from the following detailed description of example structures in accordance with this disclosure.

DETAILED DESCRIPTION OF PREFERRED EMBODIMENTS OF THE INVENTION

Figure 1:
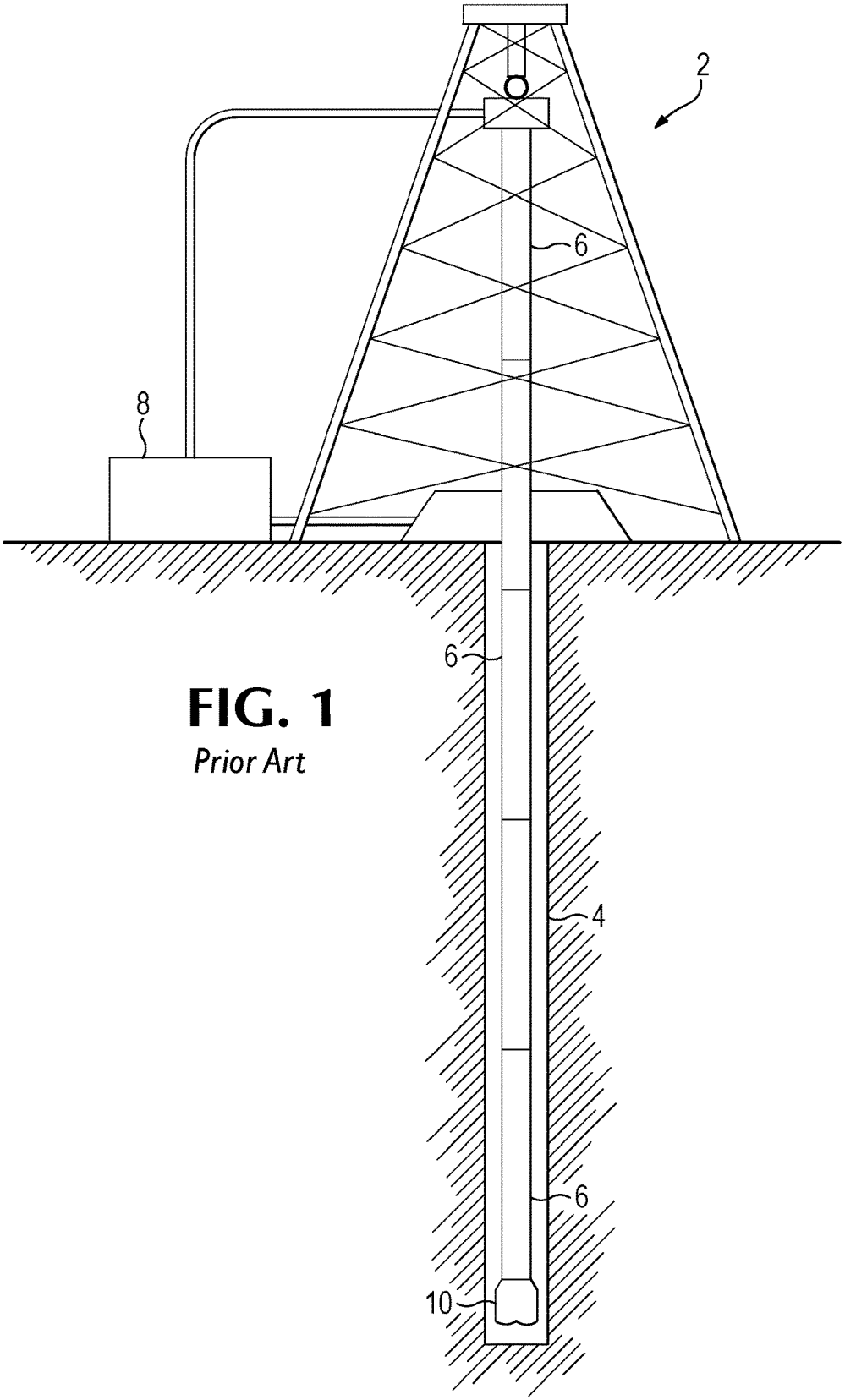
FIG. 1 Prior Art
FIG. 1 is a schematic depiction of a drilling system according to an exemplary embodiment of the present invention.

Bits used in downhole boring operations such as for gas and oil exploration operate at extreme conditions of heat and pressure often miles underground. The rate of penetration of the bit in creating the borehole is one factor to producing a cost effective drilling operation. The rate of penetration depends on several factors including the density of the rock the borehole passes through, the configuration of the bit and the weight on bit (WOB) among others.

Drag bits most often include PDC cutters mounted on blades of the bit that engage the surfaces of the borehole to fail the rock in the borehole. Each cutter is retained in a recess of the blade and secured by brazing, welding or other method. Drilling fluid is pumped down the drill string and through outlets or nozzles in the bit to flush the rock cuttings away from the bit and up the borehole annulus. While the invention is described in terms a drag bit, this is for the purpose of explanation and description. The invention is also applicable to core bits, reamers and other downhole cutting tools.

Some materials the bit advances through, such as shale, forms a sticky clay when the failed material absorbs water. Clays tend to cling to the surface of the channels of the bit, which results in narrowing the fluid passage through the channel and increasing channel pressure. The increased channel pressure together with expansion of the material as it absorbs water tends to promote more agglomeration of the clays which further bogs down the bit and decreases operation efficiency.

In one embodiment, a bit 10 includes a blade 12 with an inner portion 12A that supports one or more inner cutters 16 on the blade leading edge, and an outer portion 12B supporting one or more outer cutters 20 on the blade leading edge (FIGS. 2-11). The tables or forward faces of the inner cutters 16 are generally aligned with each other in a linear or curved arrangement. Likewise, the tables or forward faces of the outer cutters 20 are generally aligned with each other in a linear or curved arrangement. The outer cutters 20 are rearwardly and/or rotationally offset from the inner cutters 16. The alignment of the outer cutters 20 is not a continuation of the alignment of the inner cutters 16.

For purposes of this application, the inner cutters 16 and the outer cutters 20 are those primarily exposed on the downward facing surface of the bit (i.e., the nose and inner shoulder) and does not include those on the outer shoulder or gauge portions of the bit. Though these outer and gauge portions can have cutters that are aligned in the same way with the outer cutters 20 of this application, they need not be so for this application. Moreover, the inner and outer regions of the offset blades could have cutters that are not aligned and are not a part of the inner cutters 16 and outer cutters 20 on the leading edge of the blade. For example, cutters can be positioned on the face of the blade behind the leading edge of the blade. Preferably, the inner region includes inner cutters 16 generally aligned with each other on the blade leading edge and the outer region includes all outer cutters 20 along the leading edge generally aligned with each other.

Figure 2:
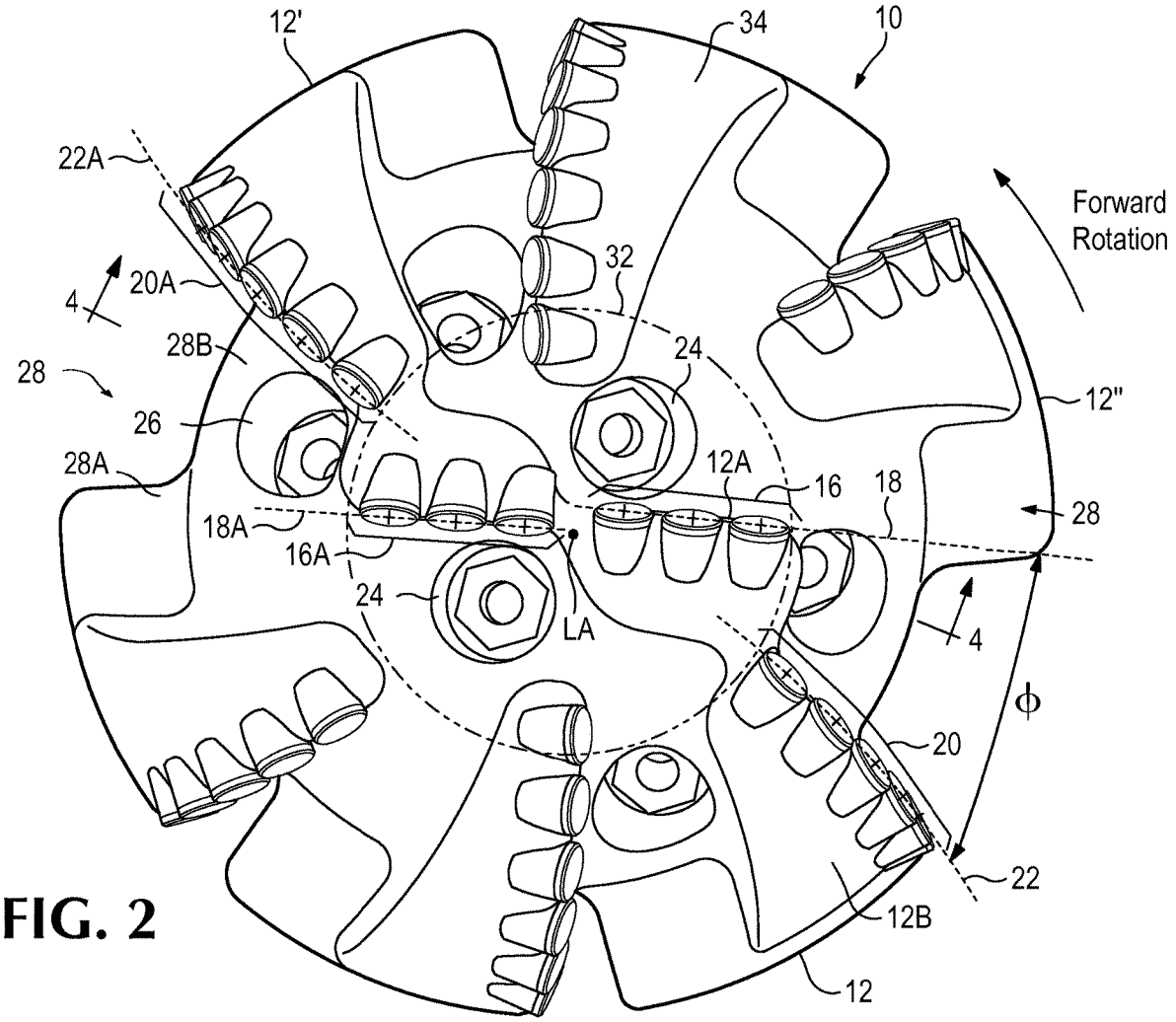
FIG. 2 is a front view of the inventive bit.

In the first illustrated embodiment, the forward faces of the tables (e.g., the diamond tables) on the inner cutters 16 are arranged in a linear manner along an inner line 18 (FIG. 2). Line 18 preferably extends outward and generally through the center of the faces of the aligned cutters, though some discrepancy in the alignment generally occurs through tolerances, manufacturing processes or by design. The outer cutters 20 are likewise arranged in general alignment along an outer line 22. Line 22 also preferably extends outward from the nose of the bit, and rotationally rearward of line 18. In this embodiment, lines 18, 22 are both generally linear but they could be curved.

The alignment of the cutters can be referenced by any consistent reference point of the cutters on the leading edge of the blade. The cutter reference point can be the center of the front face or the working edge of the front face extending farthest from the bit body. Other reference points can be used to define the lines. Cutter mounting methods can engender significant variation from the intended mounting position on the blade. The lines 18 and 22 can be defined by a best fit linear line or curve of the cutter reference points as viewed along the longitudinal axis LA of the bit. The general alignment of the inner and outer cutters for this application is radially outward as when viewing a plan view of the bottom of the bit. The cutters can also be arranged at different heights from the bit body such as seen in a vertical cross sectional view of the bit. The relative heights of the cutters may also be in alignment but they could be otherwise arranged.

The inner cutters 16 are rotationally offset from the outer cutters 20. As seen in FIG. 2, line 18 is at an angle Φ to line 22. In bit 10, the lines 18, 20 are generally linear and extend radially outward from the longitudinal axis LA. Angle Φ in a preferred embodiment is in an inclusive range of 5 to 45 degrees with the outer cutters rearward from the inner cutters, but the rotational offset angle is not limited to these values. Rotational offset angle Φ can include values greater or smaller than the range indicated. In one embodiment the angle is greater than 10 degrees. In a preferred embodiment the angle is greater than 20 degrees.

The inner and outer cutters 16, 20 could also be arranged along lines that do not intersect the longitudinal axis LA. The rotational offset angle could still be determined from the intersection of the two lines 18, 22. Additionally, the outer cutters 20 could be rearwardly spaced from the inner cutters 16 with an offset shoulder (existing or formed as a gap) even if a rotational measure is not relevant due to the positioning of the inner and outer blade portions. In a preferred construction, the forward faces of the outer cutters 20 are entirely rearward of the base portions of the inner cutters 16 though the offset could be less.

The offset blades are preferably continuous through the transition between the inner region and the outer region. Nevertheless, a gap could exist between the two regions so that the offset blade could be made up of an inner discrete blade segment and an outer discrete blade segment. These blade segments are intended to be relatively close to each other so they approximate the operation of the continuous offset blade. For discontinuous blades with discrete inner and outer blades the rotational offset angle is still preferably within the same ranges as a continuous offset blade. Such discrete blade segments are not substantially overlapping each other to be considered a single offset blade.

Offsetting of the inner and outer cutters allows better flushing of the cut material away from the inner cutters and outer cutters with limited intermixing. Intermixing in the channels can allow sticky materials such as clay to agglomerate or ball and clog the channels when stuck to the channel surface. By limiting the mixing in the channel and limiting pressure, balling of the clays is reduced.

Figure 3:
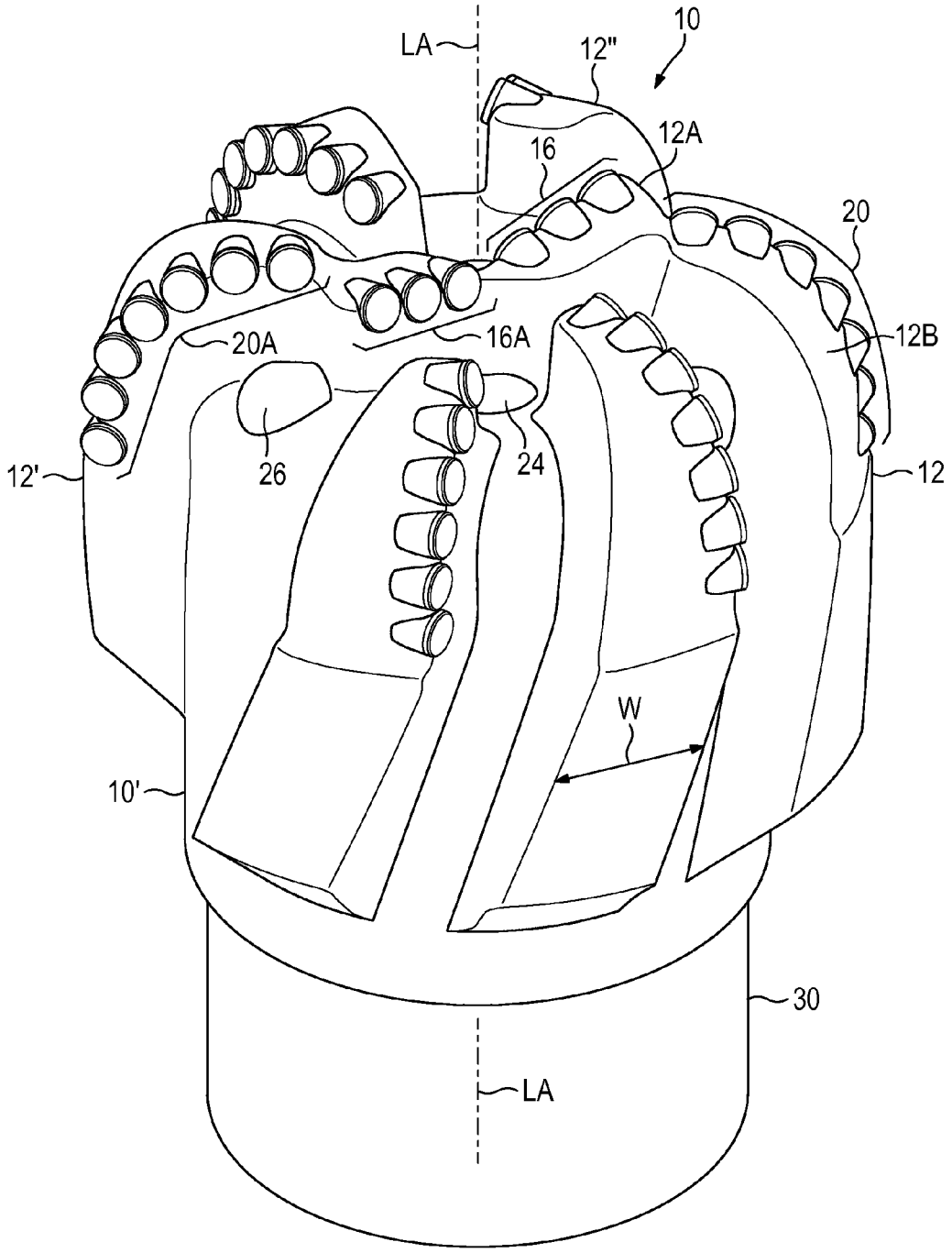
FIG. 3 is a side perspective view of the bit of FIG. 2.
Figure 4:
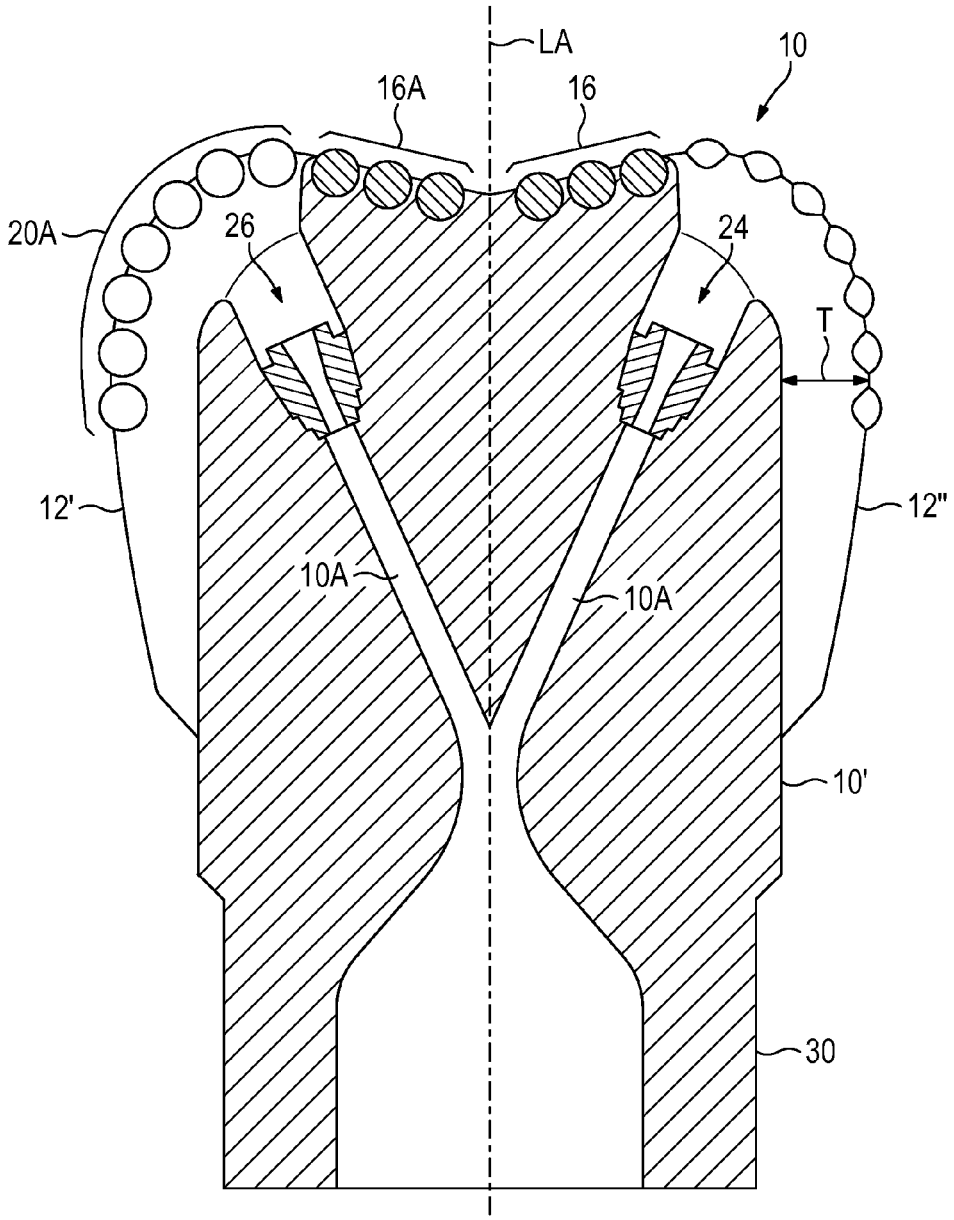
FIG. 4 is a partial cross section view of the inventive bit showing internal construction of the drill bit and the recess.

The blade has a thickness T from the bit body as shown in FIG. 4 and a width W as shown in FIG. 3. The blade may increase in radial thickness T above the bit body as the blade extends away from the longitudinal axis, but is preferably free of discontinuities in the thickness, i.e., the blade does not have significant gaps. In a preferred construction, blade 12 is continuous without holes or gaps. Nevertheless, blade 12 could be discontinuous and formed of a discrete inner blade and a discrete outer blade, or formed with holes or gaps in the blade or at the offset shoulder between the inner and outer regions.

The blade can be oriented differently in the azimuthal direction (i.e., the forward and rearward direction in relation to bit rotation) extending away from the longitudinal axis. The rotational offset between the inner cutters and the outer cutters can coincide with an offset of the blade. The leading edge can jog transversely rearward to accommodate the rotational offset between the inner and outer cutters. This shift in the blade can increase the strength of the blade. Blade strength is generally measured as the amount of force required to fracture the blade applied to the leading edge of the blade rearward. At the jog of the blade, the material resisting the applied force on the blade may be doubled, increasing the strength of the whole blade significantly.

Inner region 32 can overlap the outer region 34 with cutters of the outer region following cutters of the inner region. For effective removal of clay materials, the overlap of leading edge cutters is limited to overlap of the outermost inner cutter and the innermost outer cutter.

The discontinuity or jog of the blade can be sharp and abrupt. Alternatively, the discontinuity can be a smooth transition. The bit of FIG. 2 includes conventional blades without rotationally offset inner and outer cutters combined with offset blades with offset cutters. In some cases blades extend only through an outer region 34 without extending inward to the longitudinal axis. The bit could also be formed entirely with offset blades.

In operation, bit 10 rotates so the cutters engage the borehole and fail the rock to advance the borehole. Bit 10 can include additional blades with offset cutters. The bit of FIG. 2 includes second blade 12' opposite blade 12. Blade 12' is similar to blade 12 and includes inner cutters 16A and outer cutters 20A with cutting faces aligned along lines 18A and 20A respectively. Lines 18A and 20A extend radially outward from the longitudinal axis.

In one embodiment, lines 18 and 18A are continuous without angular discontinuities so inner cutters 16 and 16A are similarly aligned. Lines 22 and 22A are also shown as continuous with outer cutters 20 and 20A similarly aligned. With similar alignments, the inner cutters are continuous through the longitudinal axis. Alternatively, bits may include inner cutters and outer cutters not continuously aligned through the longitudinal axis. The inner cutters may comprise one, two or more cutters. The outer cutters may comprise one, two or more cutters. The number of inner and outer cutters on one blade can be the same or different from the number of inner or outer cutters on another blade. Preferably as seen in FIG. 2, the division between inner and outer cutters is within the overall width of the bit body but variations are possible.

Bits 10 typically operate in a counterclockwise direction in the view of FIG. 2 with diamond tables of the cutter facing forward. Bit 10 may further include a third blade 12" forward of, and adjacent to blade 12. Blade 12 and blade 12" define a channel 28 between the blades. During operation, material of the borehole wall failed by cutters 16 and 20 is continually deposited in the channel and is flushed from the channel.

Bit body 10' includes a pin 30 spaced from the nose or face of the bit for attaching the bit to the drill string. Fluid conducted through the drill string passes through ducts 10A passing through the bit body (FIG. 4). The ducts open to the channels of the bit including channel 28 at nozzles 24 and 26. Fluid passing through the ducts and nozzles pass into the channels to flush the failed material from the channels and up the borehole around the drill string to the surface.

Bit 10 is shown with a nozzle 26 outward or at the outer end of inner cutters 16 in channel 28 forward of the outer cutters 20. A nozzle 24 is shown forward of inner cutters 16 in channel 28. The two nozzles and associated cutters of the channel function as dual channel portions. A first channel portion 28A is associated with nozzle 24 and cutters 16. A second channel portion 28B is associated with nozzle 26 and cutters 20. Although adjacent and contiguous, the first channel portion primarily flushes out debris cut by inner cutters 16 and the second channel portion primarily flushes out debris cut by outer cutters 20. The bit may include additional (or different) nozzles and ducts than those shown.

Channel 28 comprising the two channel portions generally diverges extending away from the nozzles. By diverging, the pressure in the channel is maintained at a low level in spite of material expansion. The depth of the channel can also increase extending form the nose region which serves to further decrease channel pressure. The channel depth can increase smoothly or in steps. First and second channel portions 28A and 28B can have different depths and different widths. Alternatively, first and second channel portions 28A and 28B can have similar depths and widths.

The volume of materials cut by the inner cutters and the outer cutters can be configured by the size, orientation or the number of cutters to feed proportional amounts of cut material to the two channel portions. The separate channel portions with separate fluid source nozzles flush the cut material more efficiently, removing the material before it can stick to channel surfaces. Faster removal of the cut material without increasing pressure limits the agglomeration of ribbons into a ball or mass that can occur with clays that develop from shale deposits as they absorb water. With a single line of cutters on a conventional blade more material interacts in the channel before it is flushed from the bit allowing it to ball in the channel and stick to surfaces. The inner cutters and the outer cutters are mounted on the leading edge of the blade adjacent the channel.

Bit 10 can include an inner region 32 proximate to the longitudinal axis LA that includes the inner cutters 16 and 16A. The outward extent of the inner cutters 16 and 16A can define the extent of inner region 32. In one preferred embodiment, the inner region includes cutters on the nose and shoulder of the bit. Outer region 34 is spaced from the longitudinal axis and outside of the inner region 32. Outer region 34 encompasses the outer or shoulder cutters 20 and 20A. Variations are possible. The inner region 32 could extend less far or farther from the longitudinal axis LA with an accompanying change to the outer region 34. The cutters within the inner region 32 are offset rotationally from the cutters of the outer region 34. The inner region can further encompass the nozzles forward of the inner cutters. The outer region 34 can encompass cutters on the nose and shoulder of the bit, and nozzles forward of the outer cutters.

Figure 5:
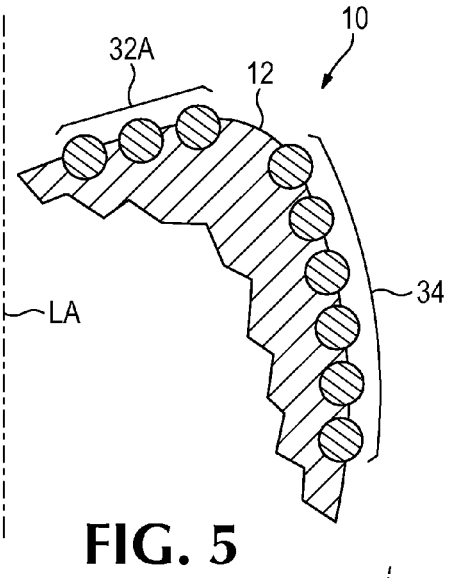
FIG. 5 is a cross section of a portion of a bit with a recessed cone inner region and an outer region.
Figure 6:
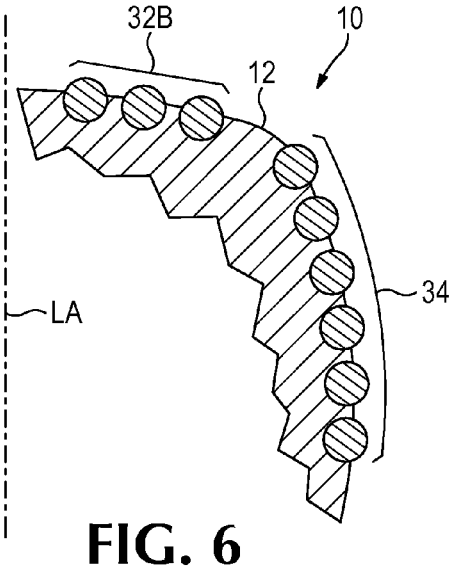
FIG. 6 is a cross section of a portion of a bit with a protruding inner region and an outer region.
Figure 7:
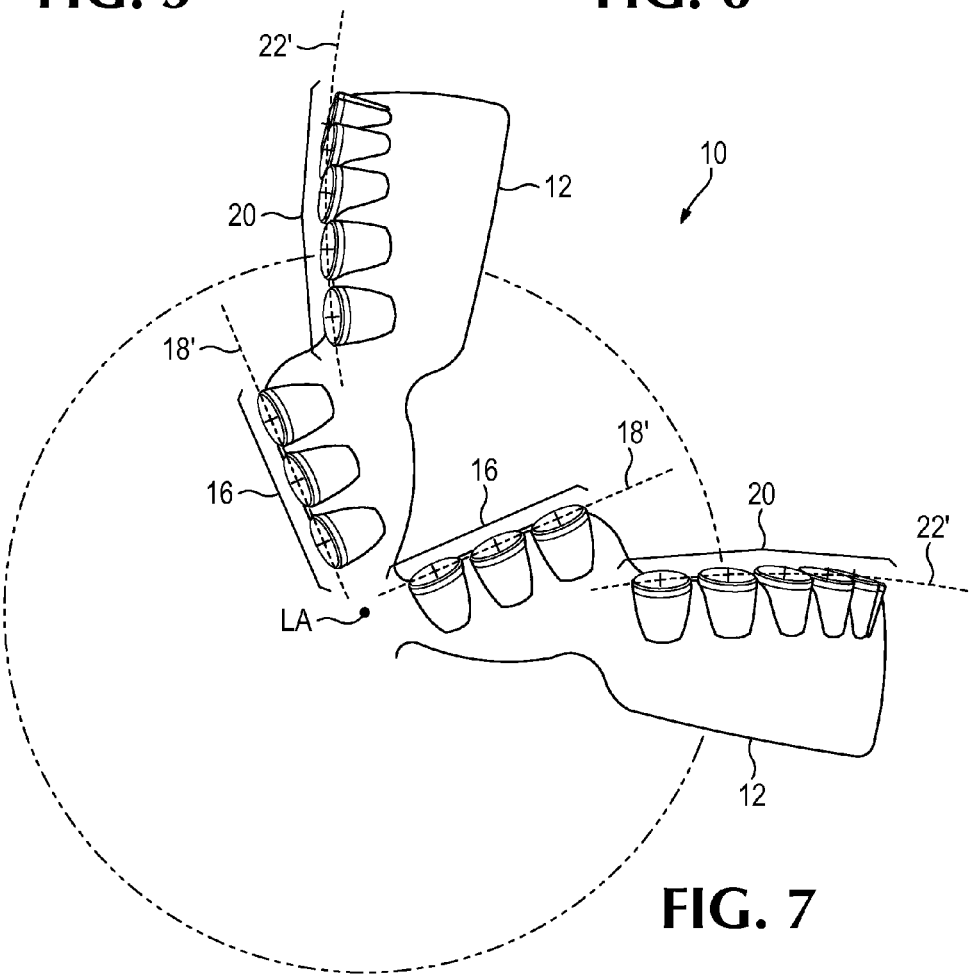
FIG. 7 is a front view of a portion of the bit.

The inner region 32A can be concave or recessed as shown in FIG. 5 so the cutters at the outer region advance the outer region of the borehole first. In some instances this configuration can limit whirl of the bit in the borehole. Alternatively, as shown in FIG. 6, the inner region 32B can be flat or can protrude beyond the outer region. With the inner region protruding, cutters of the inner region advance the middle of the borehole before the outer region. Other variations in bit shape are also possible.

Lines defining the cutter alignment can extend as straight lines 18' and 22'. Alternatively, one or both lines can extend along a radial curve. The line 22" can curve generally, can curve about a radius of curvature or can follow an exponential curve. The inner and outer cutters are preferably aligned along lines that intersect the longitudinal axis LA whether the lines are linear or curved, but they could extend such they do not extend through the longitudinal axis.

Although FIG. 2 shows a bit with six blades and two sets of inner cutters, bits with other configurations and more or fewer blades, cutters and nozzles than shown are possible.

Figure 9:
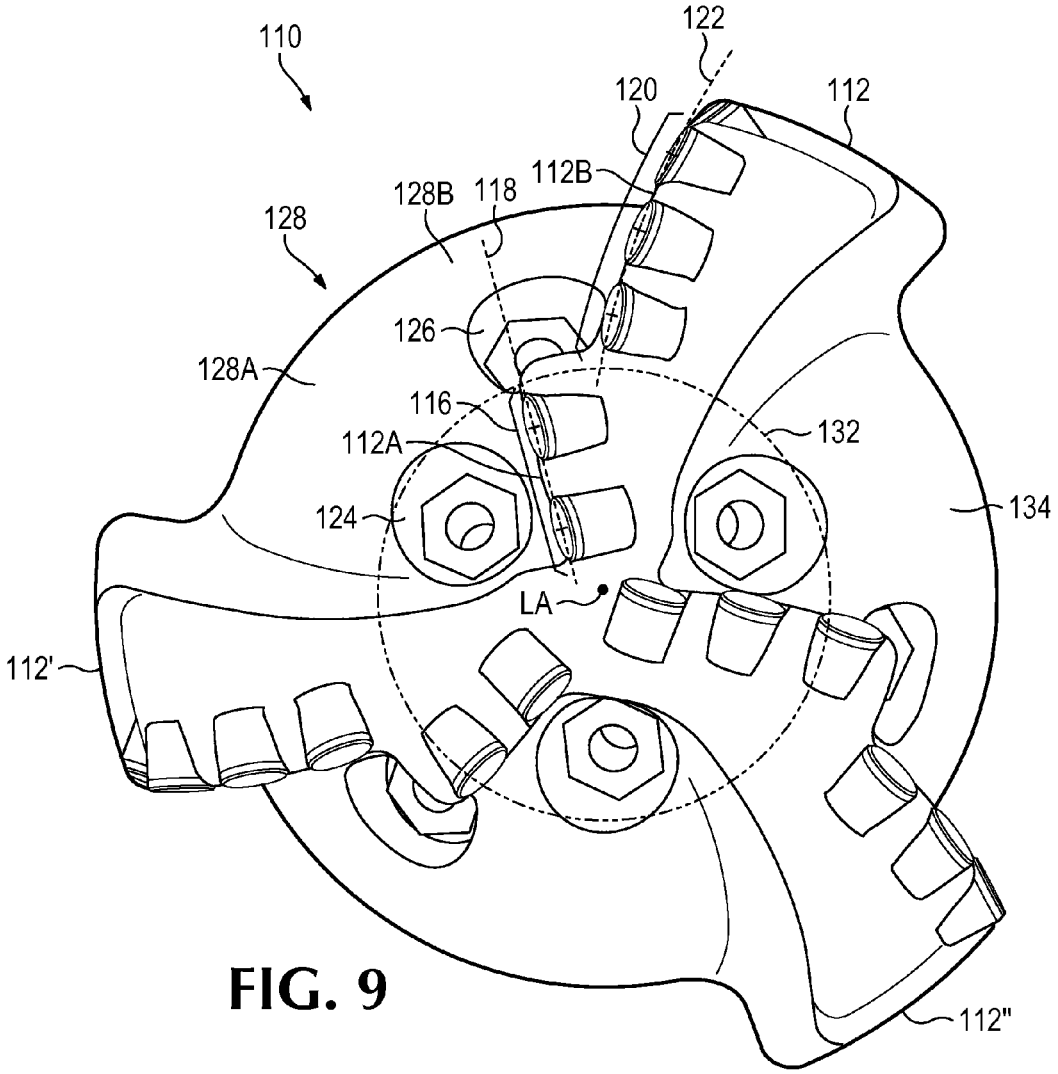
FIG. 9 is a front view of an alternative embodiment of the inventive bit.
Figure 10:
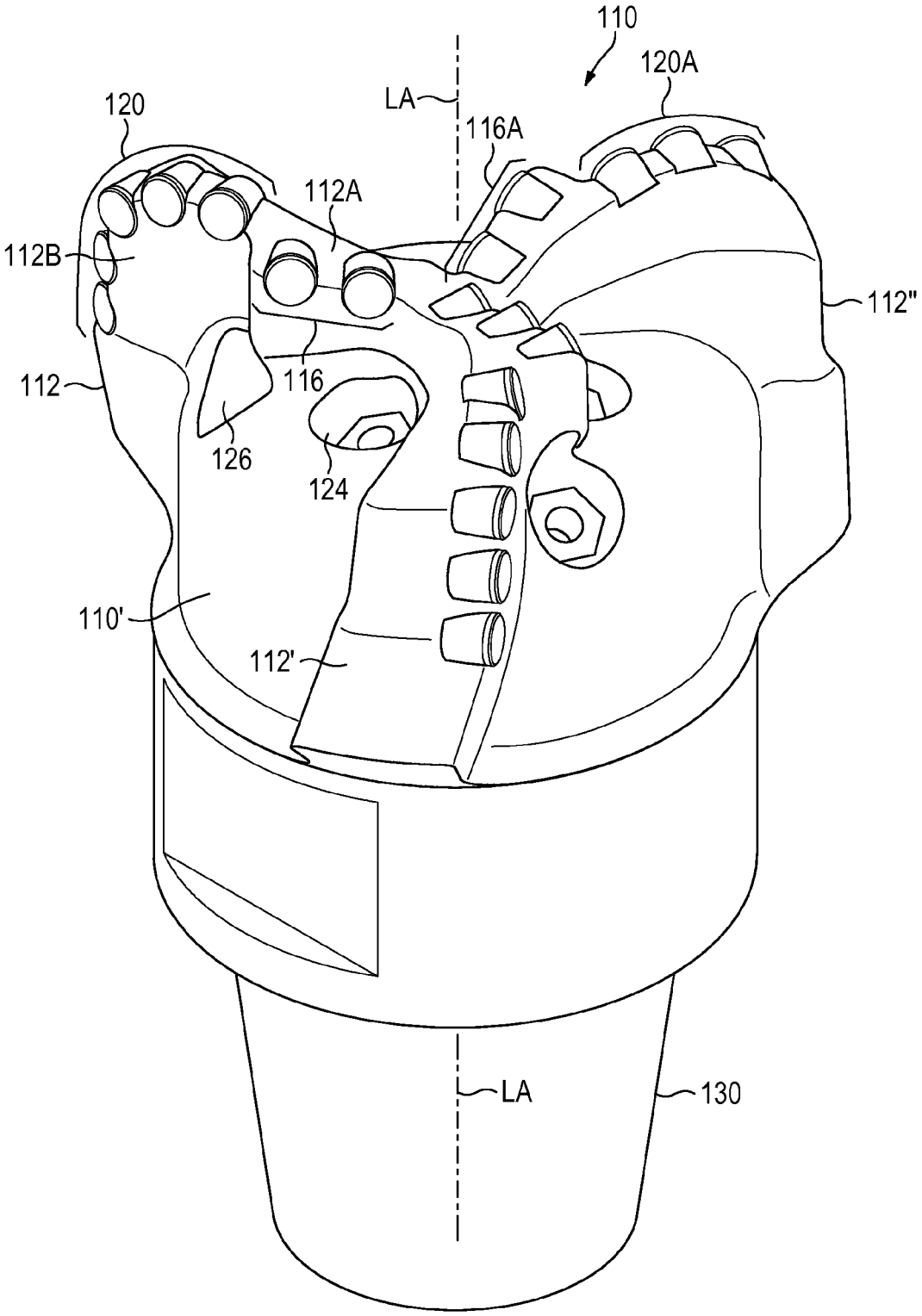
FIG. 10 is a front perspective view of the bit of FIG. 9.

FIGS. 9 and 10 show a front view and a side perspective view of a bit 110 with a blade 112, a second blade 112' and a third blade 112" each supporting cutters along a leading edge. Blade 112 includes an inner portion 112A with inner cutters 116 and an outer portion 112B with outer cutters 120. Second blade 112' forward of blade 112 defines a channel 128 between the two blades. A nozzle 126 outward of inner cutter set 116 and forward of outer cutter set 120 opens in channel 128. A second nozzle 124 opens in channel 128 forward of the outer cutters 120. Channel 128 may function as two channel portions 128A and 128B associated with nozzles 124 and 126 respectively.

Channel 128 functions in a similar manner to channel 28. Material cut by inner cutter set 116 is flushed by fluid from nozzle 124 through channel portion 128A. Material cut by outer cutters 120 is flushed by fluid from nozzle 126 through channel portion 128B. The parallel diverging channel portions reduce pressure in the channel and limit agglomeration of materials that when balled together can clog the channels.

Bit 110 has an inner region 132 about the longitudinal axis that encompasses and is defined by the extent of inner cutters 116. Outside of inner portion 132 outer region 134 includes outer cutters 120. The front faces of the inner cutters 116 are generally positioned extending along a linear line 118. The outer cutters 120 are generally aligned along a curved line 122. The inner and outer cutter alignments are rotationally offset from each other at an angle Φ.

Figure 8:
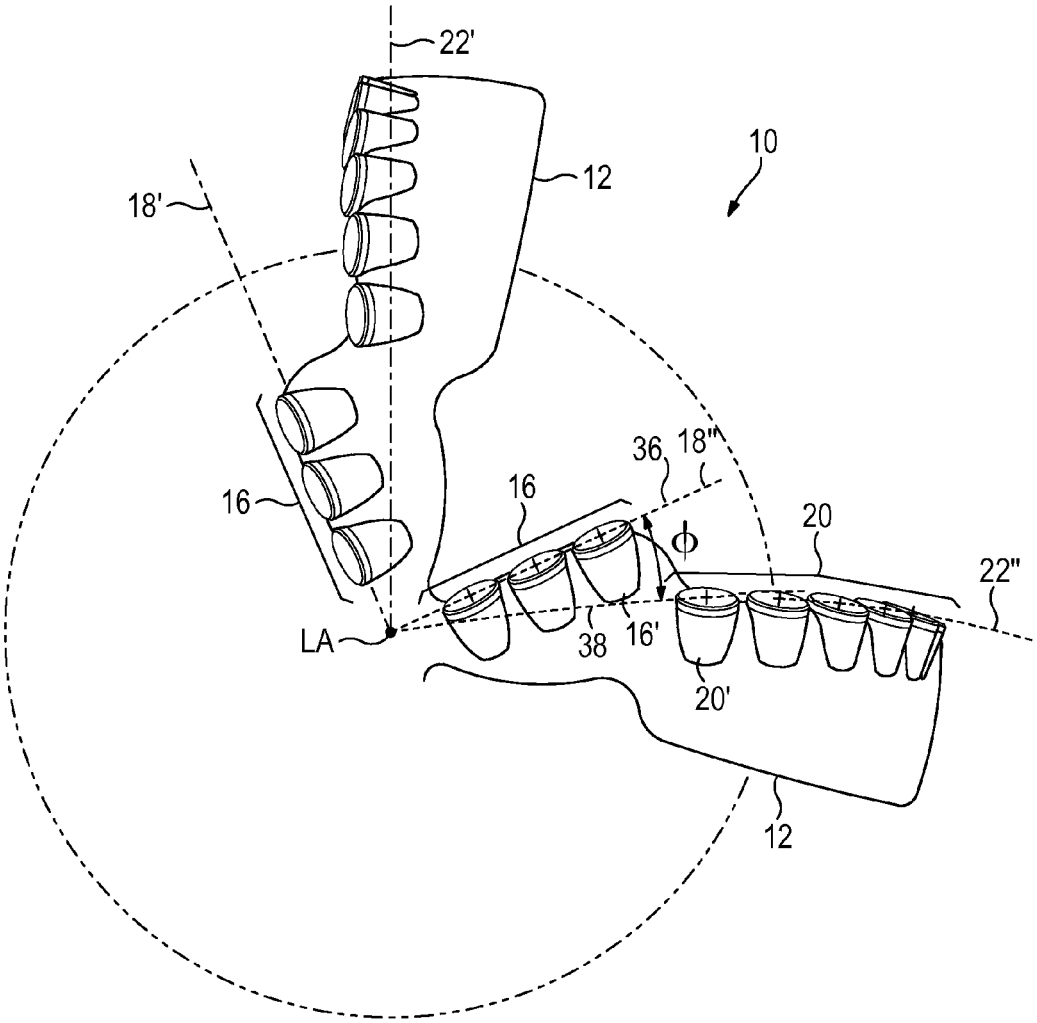
FIG. 8 is a front view of a portion of the bit.

As shown in FIG. 8, the rotational offset of the inner and outer cutters can be defined by the angle between lines 36 and 38. When one or more of the lines are curved, the rotational offset angle Φ is defined by the angle between an inner line 36 coincident with line 18' extending from the longitudinal axis LA and the forward face center point of the outermost inner cutter 16' and an outer line 38 extending from the axis LA to the forward face center point of the innermost outer cutter 20'. As noted above, in a preferred embodiment, the rotational offset of the inner and outer cutters is in an inclusive range of 5 to 45 degrees, but the rotational offset is not limited to these values. The rotational offset can include values greater or smaller than the range indicated. In one embodiment the offset angle is greater than 10 degrees. In a preferred embodiment the offset angle is greater than 20 degrees.

In an alternative embodiment the bit can be a core bit that advances the borehole as a ring around a core of strata. The core advances into a central opening in the bit and is collected for analysis. The core bit can include blades that extend from the opening around a shoulder of the bit supporting cutters on the leading edges. A first inner set of cutters are mounted on an inner region of the bit. One or more of the inner cutters are mounted adjacent the opening and function to shape the core sample as a cylinder. Some or all of the inner set of cutters can be plural set with overlap in the cutting profile and similar radial positions from the longitudinal axis of the bit.

Coring bits fail strata material over a smaller area about the core opening than a conventional bit in advancing the borehole. Additional cutters at the front edge of the bit and core opening can form a denser cutting profile. The working portion of a mounted cutter is the portion of the table extending furthest from the bit body that engages the borehole. Cutters set side to side on the leading edge of the blade are limited in their maximum density of cutter working portion engaging the borehole. By rotationally offsetting the inner cutters from the outer cutters, the cutters can overlap in the cutting profile. The innermost cutter of the outer cutters can be positioned behind the inner cutters with a limited radial offset from the forward cutter. This can provide a higher density of cutter working portion on the front of the bit. The forward cutters deposit cut material into the channel forward of the trailing outer cutters. This limits clogging of the outer cutters with cut material.

Figure 11:
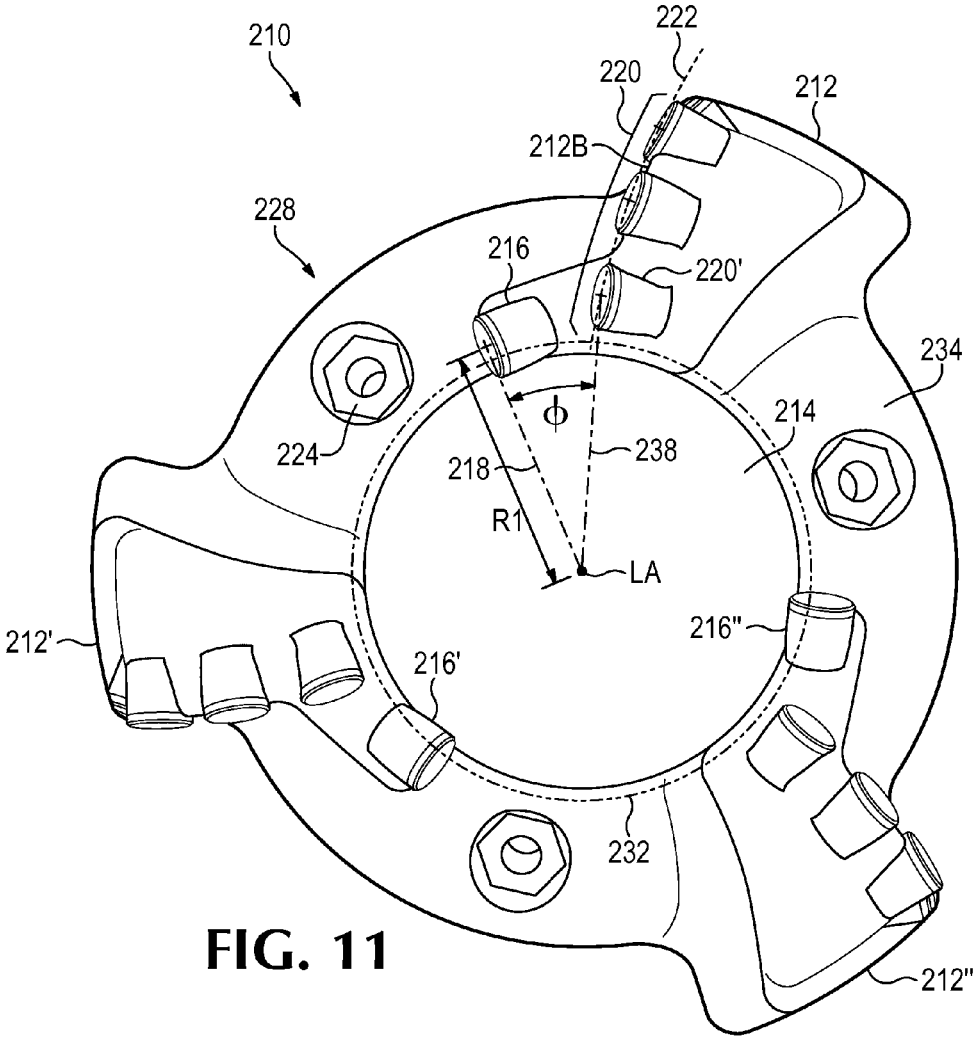
FIG. 11 is a front view of a core bit.

FIG. 11 shows a coring bit 210 with blades 212, 212' and 212". The bit includes an opening 214 for accepting a strata core for collection. Cutters 216, 216' and 216" are shown mounted on a leading edge of the blades at similar radial distances from the longitudinal axis in inner bit region 232, following each other as the bit rotates. These inner cutters cut the core sample about the circumference to form a cylinder. The inner cutters can extend into the circumference of the opening to cut core sample to a smaller diameter than the opening 214. The cutters in some embodiments can be ground to remove material on the side of the cutter to adjust the cutting distance of each inner cutter from the longitudinal axis.

Outer cutters 220 can be similarly mounted to the leading edge 212B of the blade 212 in an outer portion 234 spaced from the longitudinal axis. The outer cutters can be aligned along a straight or curved line 222. An innermost outer cutter 220' can be mounted to the blade behind inner cutter 216. The radial distance of the center of cutter 220' can be greater than the radial distance R1 of line 218 to the center of cutter 216 from the longitudinal axis and less than distance R1 plus the diameter of the cutter so the profile of cutters 216 and 220' overlap. This provides a more continuous cutter working portion at the front of the bit and greater cutting density about the opening 214.

The outer cutters on the outer portion 234 of the bit can be multiset, each cutter with a unique radial position. The outer cutters can extend along a curved or straight line extending from the nose or core opening of the bit. Similar to previous embodiments, the inner set of cutters is rotationally offset from the outer set of cutters. The inner cutters can be rotationally offset forward of the outer cutters or rearward of the outer cutters. Rearward offset of the inner cutters from the outer cutters can be useful for the noted purpose in the coring bit embodiment. This orientation is not an offset blade as discussed in the previous embodiments for reducing clogging.

The inner and outer cutters are preferably on the same continuous blade. The rotational offset between the inner cutters and the outer cutters can coincide with an offset of the blade. The leading edge can jog transversely rearward to accommodate the rotational offset between the inner and outer cutters. The blade with an inner set of cutters and an outer set of cutters has a thickness t without abrupt changes or gaps. Alternatively, the inner and outer cutters can be on discontinuous blades. The discontinuous blades can have limited overlap extending from the nose or core portion of the bit.

A nozzle 224 is shown forward of inner cutter 216 to flush material failed by the cutters through channel 228. Nozzles and associated cutters are shown as similarly configured on blades 212' and 212". Alternatively, a nozzle can be forward of the outer cutters and another nozzle forward of the inner cutters to optimally flush cut material.

The rotational offset can be defined by the angle between a line 218 to the face center of the outermost inner cutter 216 and line 238 extending from the longitudinal axis to the face centers of innermost outer cutter 220'.

Cutters can be mounted to the blades with side rake or back rake to facilitate cutting the core or strata of the borehole. Inner cutters can be mounted with positive back rake so the cutter face has a forward directional component along the longitudinal axis. This can reduce generation of long fractures or slabs when cutting material from the core sample. Inner cutters can be mounted with negative side rake so the cutter face has an outward directional component away from the longitudinal axis. This orientation of the cutter can direct cuttings toward the channel and into the fluid stream. Movement of cut material away from the core reduces interference between the core sample and the opening of the bit that can jam the core and limit movement into the opening. Other configurations and cutter orientations are possible.

In an alternative embodiment, the inner cutter can follow the innermost outer cutter 220 and overlap the cutting profile of the innermost outer cutter. In another alternative embodiment, a nozzle is positioned behind the outer cutters adjacent an inner cutter. In another alternative embodiment, the inner cutters can include two or more cutters mounted to the edge of the opening 214. The leading edge of the blade can extend to include a portion of the circumference of opening 214 proximate the blade so that two plural set inner cutters can be mounted to the leading edge 212B of the blade. The rotational offset is then determined from the inner cutter 216 closest innermost outer cutter 220'.

Although bit examples with three and six blades are shown here as examples, these should not be considered a limitation. Other configurations of a drill bit with sets of cutters rotationally offset are possible. Any number of blades can be considered with various combinations of offset and non-offset cutters and still fall within the scope of this disclosure.

It should be appreciated that although selected embodiments of the representative bits incorporating split blades are disclosed herein, numerous variations of these embodiments may be envisioned by one of ordinary skill that do not deviate from the scope of the present disclosure. This presently disclosed invention lends itself to use for steel and matrix bits as well as a variety of styles and materials of cutters.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites “a” or “a first”

element or the equivalent thereof, such description includes one or more such elements, neither requiring nor excluding two or more such elements.

The invention claimed is:

1. A drill bit to advance a borehole comprising:

a drag bit body having a face on which is defined a plurality of blades extending from the face and separated by channels between the blades s, each said blade supporting a plurality of discrete, polycrystalline diamond compact ("PDC") cutters, at least one of the blades being an offset continuous blade including:

an inner region supporting an inner set of PDC cutters along a first leading edge portion of the offset blade; and an outer region supporting an outer set of PDC cutters along a second leading edge portion of the offset blade, where the second leading edge portion is spaced rotationally rearward from the first leading edge portion.

2. The drill bit of claim 1 wherein the second leading edge portion is rearwardly offset from the first leading edge portion within an inclusive range of 5 to 45 degrees.

3. The drill bit of claim 1 wherein the second leading edge portion is rearwardly offset from the first leading edge portion by 20 to 45 degrees.

4. The drill bit of claim 3 wherein the rearward offset is referenced at the center of the face of the outermost of the inner set of cutters and the center of the face of the innermost of the outer set of cutters.

5. The drill bit of claim 1 including an inner nozzle adjacent the inner set of PDC cutters, and an outer nozzle adjacent the outer set of PDC cutters.

6. The drill bit of claim 1 wherein the offset ridge supporting the inner set of PDC cutters and the outer set of PDC cutters has a continuous construction.

7. The drill bit of claim 1 wherein the offset ridge includes a first discrete segment supporting the inner set of PDC cutters, and a second discrete segment supporting the outer set of PDC cutters.

8. A drill bit for advancing a borehole comprising:

a drag bit body including a plurality of upraised continuous blades;

a channel with first and second contiguous channel portions between a pair of said blades;

one or more inner PDC cutters supported by a first of said pair of blades, the first channel portion extending radially outward in front of the one or more inner PDC cutters;

a first nozzle at an inner end of the first channel portion to flush material from the one or more inner PDC cutters;

one or more outer PDC cutters supported by the first of said blades, the one or more outer PDC cutters being spaced rotationally rearward from the one or more inner PDC cutters, the second channel portion extending radially outward in front of the one or more outer PDC cutters and rearward of the first channel portion; and a second nozzle at the inner end of the second channel portion radially outward of the first nozzle and rotationally rearwardly spaced from the first nozzle to flush material from the one or more outer PDC cutters.

9. The drill bit of claim 8 where the first of said blades includes a plurality of the inner PDC cutters and a plurality of the outer PDC cutters, the inner PDC cutters are aligned along a first line extending from an axis of the bit, and the outer PDC cutters are aligned along a second line extending from the axis of the bit that has a different trajectory from the first line.

10. The drill bit of claim 9 where the first and second lines are each linear.

11. The drill bit of claim 9 where the first and second lines are each curved along an arc.

12. A drill bit for advancing a borehole comprising:

a plurality of blades defining a radially extending channel between each pair of adjacent blades;

at least one of the blades being an offset continuous blade including one or more inner PDC cutters arranged such that a first line extends along the forward face of each said inner PDC cutter, and one or more outer PDC cutters arranged such that a second line extends along the forward face of each said outer PDC cutter and is rearwardly spaced from the first line; and a first nozzle adjacent the one or more inner PDC cutters to flush material through one of said channels.

13. The drill bit of claim 12 including a second nozzle adjacent the one or more outer PDC cutters to flush material through one of said channels.

14. The drill bit of claim 13 wherein each said inner PDC cutter includes a substrate supporting a PDC table, and the second nozzle is rotationally rearward of the base of each said inner PDC cutter.

15. The drill bit of claim 12 wherein each said offset blade has a continuous construction.

16. The drill bit of claim 12 wherein each said offset blade is formed of a discrete inner segment and a discrete outer segment.

17. The drill bit of claim 16 wherein the inner segment is rotationally offset from the outer segment by 10 to 20 degrees.

18. The drill bit of claim 12 wherein the first line has a linear extension.

19. The drill bit of claim 18 wherein the second line has a linear extension.

20. The drill bit of claim 18 wherein the second line has a curved extension.

21. The drill bit of claim 12 wherein the first and second lines each has a curved extension.

22. The drill bit of claim 12 wherein the first line has a curved extension and the second line has a linear extension.

23. The drill bit of claim 12 wherein the second line is rotationally spaced from the first line by 10 to 20 degrees.

24. The drill bit of claim 12 wherein the second line is rotationally spaced from the first line by 20 to 45 degrees.

25. A PDC drill bit for advancing a borehole comprising a plurality of blades, a plurality of channels defined by said blades to direct drilling fluid and material outward, and first and second nozzles in one said channel where the second nozzle is rotationally spaced rearward of the first nozzle, and the first nozzle and second nozzle are directly rotationally forward of the same blade, wherein one of said blades is an offset continuous blade and forms a rear boundary for said one channel, said offset blade includes a first leading edge supporting one or more inner PDC cutters and a second leading edge supporting one or more outer PDC cutters, the second leading edge being radially outward and rearwardly offset from the first leading edge.

26. The drill bit of claim 25 wherein the first leading edge supports a plurality of said inner cutters each having a forward face arranged such that a first line extends along the forward faces of the inner cutters, and the second leading edge supports a plurality of said outer cutters each having a forward face arranged such that a second line extends along the forward faces of the outer cutters, the second line not being continuous with the first line.

27. The drill bit of claim 26 wherein the first line is rearwardly offset from the second line within an inclusive range of 5 to 45 degrees.

28. The drill bit of claim 26 wherein at least one of the first and second lines has a linear extension.

29. The drill bit of claim 26 wherein at least one of the first and second lines has a curved extension.

30. The drill bit of claim 26 wherein the second line is rotationally spaced rearward of the first line by 10 to 20 degrees.

31. The drill bit of claim 26 wherein the second line is rotationally spaced rearward of the first line by 20 to 45 degrees.

32. The drill bit of claim 25 wherein the offset blade including the first and second leading edges is a single continuous structure.

33. The drill bit of claim 25 wherein the offset blade including the first and second leading edges is defined by a pair of discrete segments.

34. The drill bit of claim 25 wherein the first leading edge and the second leading edge are free of radial overlap with each other.

35. A PDC drag bit for cutting earth strata comprising a body with a rotational axis, a forward blade, a rearward continuous blade, a channel defined by the forward and rearward blades, a first set of PDC cutters on an inner portion of the rearward blade, and a second set of PDC cutters on an outer portion of the rearward blade where the first set of PDC cutters are rotationally spaced forward from the second set of PDC cutters, wherein a side of one the first set of PDC cutters is positioned at an end of the inner portion for exposure to the earth strata as the bit cuts the earth strata.

36. The drag bit of claim 35 wherein the first set of PDC cutters is rotationally offset from the second set of PDC cutters by 20 to 45 degrees.

37. The drag bit of claim 35 where the channel includes an inner nozzle forward of the first set of PDC cutters and an outer nozzle forward of the second set of (PDC) cutters to flush cuttings from the channel.

38. The drag bit of claim 35 where the rearward blade includes a leading edge and the PDC cutters are mounted on the leading edge.

39. The drag bit of claim 35 where the rearward blade with the inner set of PDC cutters and the outer set of PDC cutters has a thickness that is continuous without abrupt changes or gaps.

40. The drag bit of claim 35 where the rearward blade with the inner set of PDC cutters and the outer set of PDC cutters extends from the axis of rotation and around a shoulder of the bit.

41. The drag bit of claim 35 wherein the first set of PDC cutters includes a plurality of PDC cutters and the second set of PDC cutters includes a plurality of PDC cutters.

42. A method of using a drag bit to advance a borehole where the bit includes a channel defined by a first forward blade and second rearward continuous blade, the method comprising:

cutting, a first borehole material with a first group of aligned PDC cutters positioned on the second rearward continuous blade;

flushing the first borehole material through a forward portion of the channel with an associated forward fluid nozzle;

cutting a second borehole material with a second group of aligned PDC cutters positioned on the second rearward continuous blade, wherein the second group of aligned PDC cutters is spaced radially outward and rotationally rearward from the first group of aligned PDC cutters; and flushing the second borehole material through a rearward portion of the channel with an associated rearward fluid nozzle.

43. A method of flushing cuttings from the face of a drag bit including:

introducing, drilling, fluid into a channel through a first nozzle forward of a first set of PDC cutters aligned along a first line; and introducing drilling fluid into the channel through a second nozzle behind the first line and forward of a second set of PDC cutters aligned along a second line;

wherein the first set of cutters and the second set of cutters are attached to one continuous offset blade and the first nozzle and second nozzle are directly rotationally forward of the same blade, and wherein the second set of cutters are spaced radially outward and rotationally rearward from the first set of cutters.

* * * * *